US011521586B2

(12) United States Patent
Gabdullin

(10) Patent No.: US 11,521,586 B2
(45) Date of Patent: Dec. 6, 2022

(54) SELF-CONTAINED ENHANCED STRING INSTRUMENT

(71) Applicant: Marat Gabdullin, Edmond, OK (US)

(72) Inventor: Marat Gabdullin, Edmond, OK (US)

( * ) Notice: Subject to any disclaimer, the term of this patent is extended or adjusted under 35 U.S.C. 154(b) by 220 days.

(21) Appl. No.: 17/065,184

(22) Filed: Oct. 7, 2020

(65) Prior Publication Data

US 2021/0104214 A1 Apr. 8, 2021

Related U.S. Application Data

(60) Provisional application No. 62/912,209, filed on Oct. 8, 2019.

(51) Int. Cl.
*G10H 1/32* (2006.01)
*G10H 1/00* (2006.01)
*G10D 3/00* (2020.01)

(52) U.S. Cl.
CPC ..... *G10H 1/32* (2013.01); *G10D 3/00* (2013.01); *G10H 1/0066* (2013.01)

(58) Field of Classification Search
CPC ..... G10H 1/32; G10H 1/0066; G10D 3/00
USPC ..... 84/645
See application file for complete search history.

(56) References Cited

U.S. PATENT DOCUMENTS 4,748,887 A * 6/1988 Marshall ..... G10H 3/188 84/645
4,858,509 A * 8/1989 Marshall ..... G10H 3/188 984/367
5,142,961 A * 9/1992 Paroutaud ..... G10H 3/00 84/645
6,191,350 B1 * 2/2001 Okulov ..... G10H 3/185 84/723
6,441,293 B1 * 8/2002 LaBarbera ..... G10H 3/146 84/723
6,605,765 B1 * 8/2003 Johnson ..... G10D 3/00 84/267
10,540,951 B2 * 1/2020 Connell ..... G10H 3/186
2003/0131721 A1 * 7/2003 Minakuchi ..... G10H 3/18 84/726

(Continued)

FOREIGN PATENT DOCUMENTS

JP H0743715 U * 9/1995
WO WO-0054250 A1 * 9/2000 ..... G10H 3/26

*Primary Examiner* — Christina M Schreiber

(57) ABSTRACT

An acoustic musical instrument a hollow body, neck, speaker, and digital audio device. A control circuit is coupled to the speaker and the digital audio device. The speaker is externally positioned on the hollow body. The digital audio player is externally positioned on the hollow body. The control circuit is communicatively coupled to a MIDI component, an electronic tuner, amplifier board, and an effects board. A plurality of light emitting diodes are positioned on the neck and coupled to the control circuit. The control circuit is configured to synchronicitously energize the LEDs with an audio file that is executed by the digital audio device. The control circuit is configured to synchronicitously energize the LEDs according to instructions received external to the acoustic musical instrument. The speaker is communicatively coupled to the amplifier board. The digital audio device captures sounds that are generated by the acoustic musical instrument.

11 Claims, 4 Drawing Sheets

(56) References Cited

U.S. PATENT DOCUMENTS

| | | | | |
|---|---|---|---|---|
| 2006/0196348 | A1* | 9/2006 | Cummings | G10H 3/188 84/731 |
| 2007/0227344 | A1* | 10/2007 | Ryle | G10H 3/188 84/723 |
| 2008/0105108 | A1* | 5/2008 | Saenz | G09B 15/06 84/485 R |
| 2014/0196593 | A1* | 7/2014 | Langberg | G10D 3/00 84/723 |
| 2017/0323624 | A1* | 11/2017 | Parker | G10H 1/342 |
| 2017/0347173 | A1* | 11/2017 | Prendergast | H03F 3/181 |
| 2018/0047373 | A1* | 2/2018 | Butera | G10H 1/342 |
| 2019/0096375 | A1* | 3/2019 | May | G10H 3/24 |
| 2021/0097964 | A1* | 4/2021 | Herman | G10K 11/17854 |
| 2021/0104214 | A1* | 4/2021 | Gabdullin | G10H 1/44 |
| 2022/0036867 | A1* | 2/2022 | Jones | G10H 1/0083 |

* cited by examiner

SELF-CONTAINED ENHANCED STRING INSTRUMENT

CROSS-REFERENCE TO RELATED APPLICATIONS

This application claims priority to U.S. Provisional Application No. 62/912,209 filed Oct. 8, 2019, which is hereby incorporated herein by reference.

FIELD OF THE INVENTION

The present disclosure relates generally to string instruments. More specifically, the present disclosure describes self-contained enhanced string instruments.

BACKGROUND OF THE INVENTION

Acoustic musical instruments, unlike its electric counterpart, have undergone few updates since their inception. For example, acoustic instruments typically rely only on their acoustic capabilities for sound production and have no way to further enhance volume or tone. Acoustic string instruments are designed to be played in acoustic friendly environments, such as concert hall. However, string quartets are performed outdoors and typically suffer from reduced acoustic support. Here, having an ability to use reverb and/or increase volume would arguably enhance the performance of the instrument.

BRIEF DESCRIPTION OF THE DRAWINGS

Some of the embodiments will be described in detail, with reference to the following figures, wherein like designations denote like members, wherein.

Figure 1:
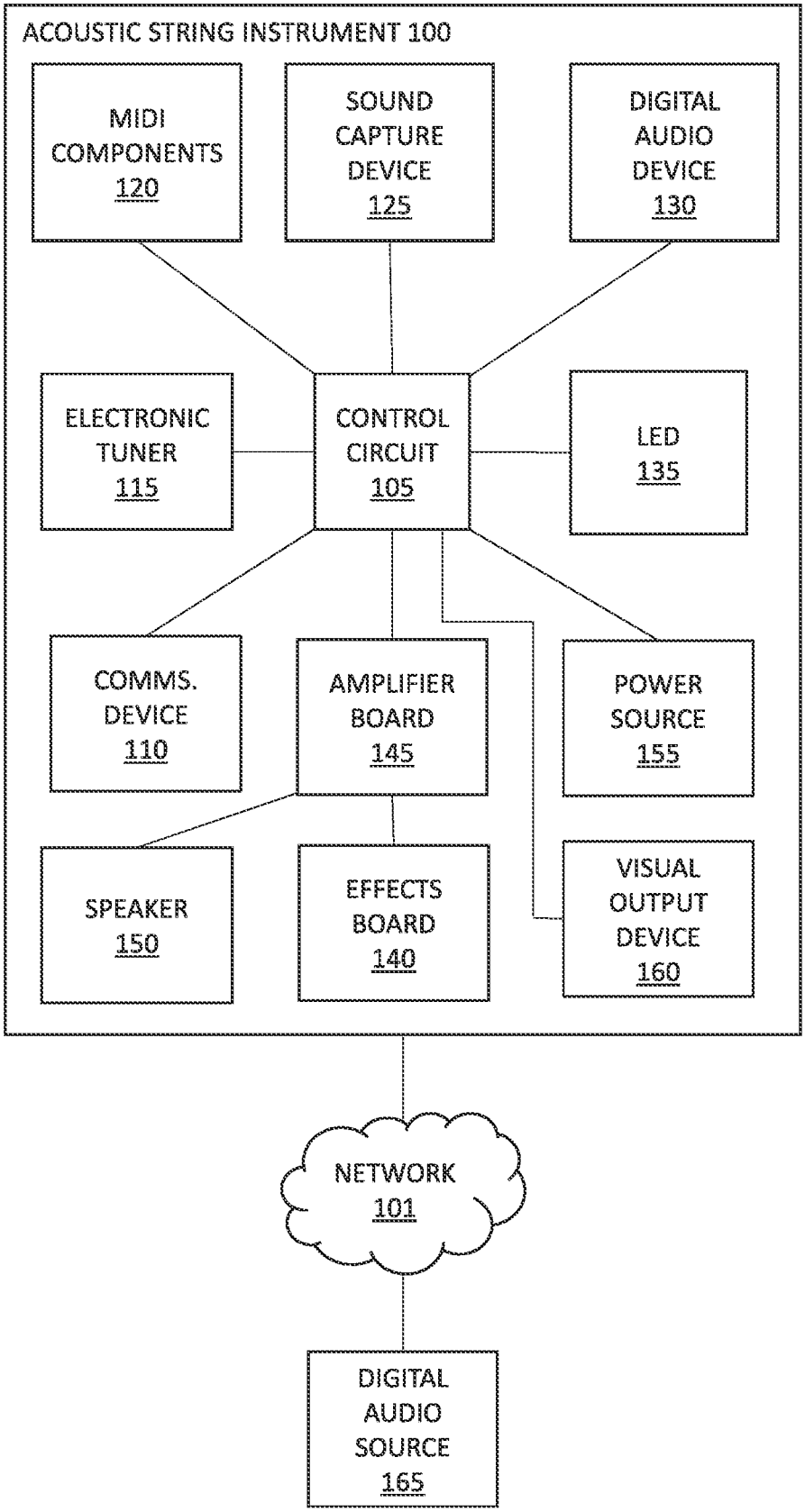
FIG. 1 depicts a block diagram of an acoustic string instrument that includes enhancing components, according to some embodiments.

Unless otherwise specifically noted, articles depicted in the drawings are not necessarily drawn to scale.

DETAIL DESCRIPTIONS OF THE INVENTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

The present disclosure includes many aspects and features. Moreover, while many aspects and features relate to, and are described in the context of detection of presence of one or more intruder devices, embodiments of the present disclosure are not limited to use only in this context.

Acoustic musical instruments, unlike its electric counterpart, has undergone few updates since their inception. For example, acoustic instruments typically rely only on their acoustic capabilities for sound production and have no way to further enhance volume or tone. Acoustic string instruments are designed to be played in acoustic friendly environments, such as concert hall. However, string quartets are performed outdoors and typically suffer from reduced acoustic support. Here, having an ability to use reverb and/or increase volume would arguably enhance the enhance the performance of the instrument.

FIG. 1 depicts a block diagram of an acoustic string instrument, generally 100, that includes enhancing components, according to some embodiments. To begin, string instruments are musical instruments that produce sound from vibrating strings when the performer plays or sounds the strings in some manner. For example, musicians play some string instruments by plucking the strings with their fingers or a plectrum—and others by hitting the strings with a light wooden hammer or by rubbing the strings with a bow.

The acoustic string instrument 100 can be any acoustic string instrument (e.g., a violin, viola, cello, bass guitar, banjo, mandolin, ukulele, guitar, or harp). The acoustic string instrument 100 preferably includes at least one electronic tuner 115, Musical Instrument Digital Interface ("MIDI") components 120, sound capture device 125, digital audio device 130, light emitting diode 135, power source 155, visual output device 160, amplifier board 145, and communications device 110 all communicatively coupled to one or more control circuits 105. The control circuit 105 can perform any step, function, and/or process disclosed herein. The electronic tuner 115 is a device that facilitates tuning the acoustic string instrument 100 and can be positioned externally on the acoustic string instrument 100 for usage by the user/musician. A speaker 150 is preferably communicatively coupled to the amplifier board 145. An effects board 140 is device that is communicatively coupled to the amplifier board 145, in certain embodiments. For example, the effects board 140 can be a device that functions as a digital reverberator that uses various signal processing algorithms in order to create a reverb effect.

In some embodiments, a power source 155 is communicatively coupled to the control circuit 105. For example, the power source 155 can include one or more batteries and/or ports (e.g., a port 245) that allows the acoustic string instrument to be coupled to an external power source. MIDI is a technical standard that describes a communications protocol, digital interface, and electrical connectors that connect a wide variety of electronic musical instruments, computers, and related audio devices for playing, editing and recording music. The MIDI components 120 preferably include one or more MIDI sensors, MIDI decoders, MIDI encoders, and/or MIDI controllers. The sound capture device 125 is preferably externally positioned on the acoustic string instrument 100. In certain embodiments, the sound capture device 125 is positioned within the acoustic string instrument 100. The digital audio device 130 preferably records and executes (i.e. plays) digital audio files. For example, the digital audio device 130 can capture, via the sound capture device 125, sounds produced by the acoustic string instrument 100 as digital audio files. In other embodiments, the control circuit 105 is configured to capture, via the digital audio device 130, sounds that are generated by the acoustic musical instrument 100 as a primary digital audio file when the acoustic musical instrument 100 is in use.

In certain embodiments, the MIDI decoder captures sounds generated by the acoustic string instrument 100 and converts them to a MIDI signal(s). The MIDI controller converts the MIDI signal to one or more pre-installed patches and enables the acoustic string instrument 100 to emulate the sounds of a different instrument (e.g., a piano). The MIDI components 120 can further include a MIDI output that allows the acoustic string instrument 100 to connect an external device, such as a digital audio workstation ("DAW"). In other embodiments, the acoustic string instrument 100 can communicate, via the communications device 110, with a digital audio source 165 via a network 101. The digital audio source 165 is a computing device that can receive and/or transmit digital audio files, in accordance with some embodiments. In some embodiments, the digital audio source 165 is a digital audio workstation. For example, the digital audio source 165 can be a laptop, mobile computing device, digital audio player, another acoustic string instrument.

The communications device 110 is an electronic device that can utilize communications protocols to exchange information with other computing devices. In other embodiments, the control circuit 105 is configured to receive, via the communications device 110, a secondary digital audio file from the digital audio source 165 for execution by the digital audio device 130 as well as transmit, via the communications device 110, the primary digital audio file to the digital audio device 130. The network 101 can be, for example, a local area network (LAN), a wide area network (WAN), such as the Internet, or a combination of the two, and can include wired, wireless, and/or fiber optic connections. The network 101 can be compatible with a variety of frequencies, such as those associated with Bluetooth, Wi-Fi, LTE, cellular, radio, microwave, as well as wireless communication. In general, the network 101 can be any combination of connections and protocols that will support communications between the acoustic string instrument 100 and the digital audio source 165.

Figure 2:
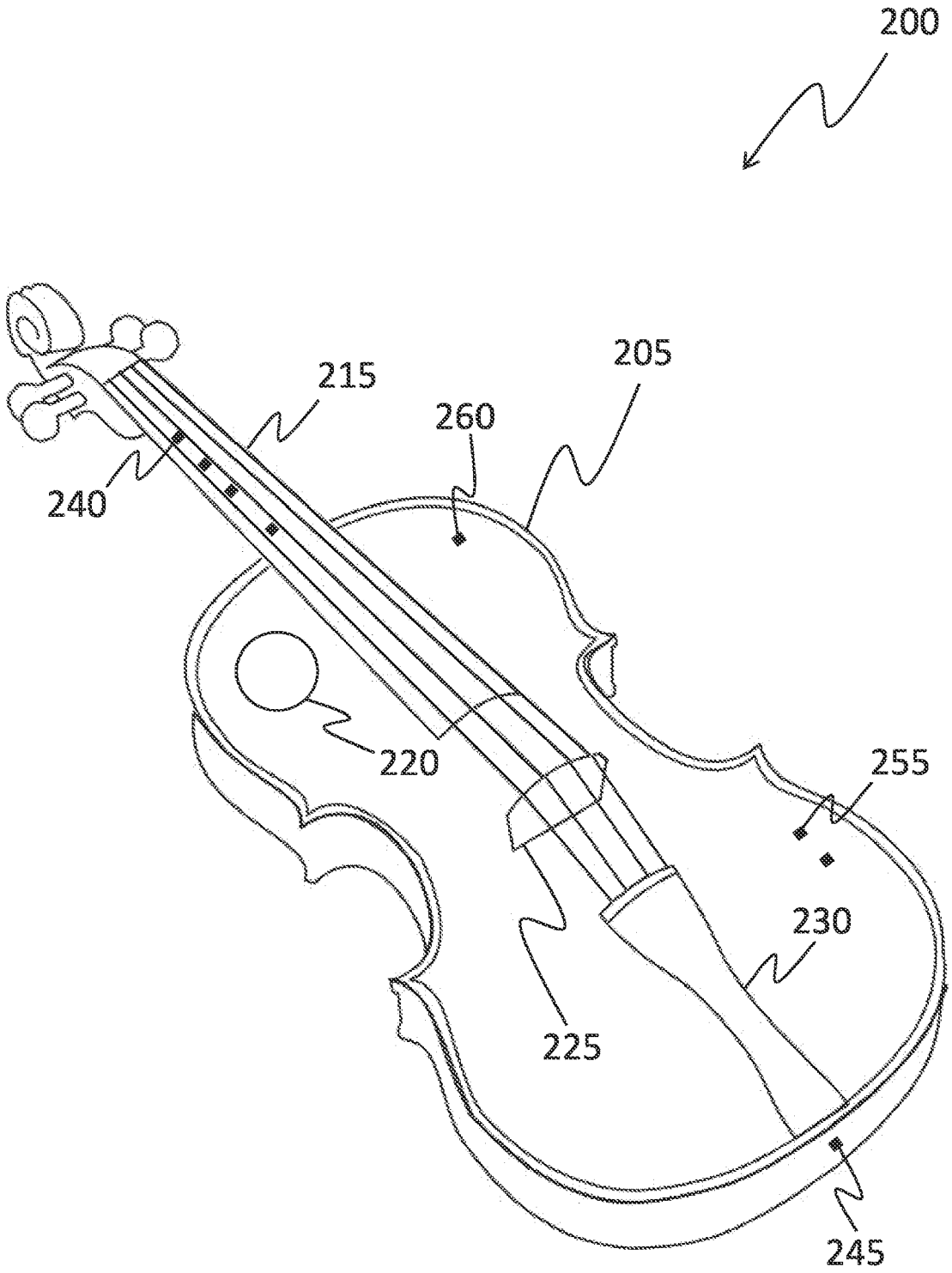
FIG. 2 illustrates a perspective view of an acoustic string instrument in the form of a violin that includes the enhancing components, according to other embodiments.

FIG. 2 illustrates a perspective view of an acoustic string instrument, generally 200, in the form of a violin that includes a plurality of the enhancing components, according to other embodiments. The acoustic string instrument 200 shares one or more of the features, components, and/or functionality of the acoustic string instrument 100 discussed above. The acoustic string instrument 200 preferably includes a hollow body 205, a neck 215 that extends from the hollow body 205. In some embodiments, the body 205 is a solid structure that is not hollow. The acoustic string instrument 200 also includes a tailpiece 230 positioned proximate to a bridge 225. In some embodiments, the acoustic string instrument 200 can be coupled to an external power source via the port 245. A speaker 220 is externally positioned on the hollow body 205. A plurality of LEDs 240 are positioned on the neck 215, according to certain embodiments. LEDs 240 can be programmed and/or controlled remotely (e.g., by the user or a third party). In other words, the control circuit 105 is configured to synchronicitously energize the LEDs 240 according to instructions received external to the acoustic musical instrument (e.g., received via the network 101), in accordance with some embodiments. In other embodiments, the control circuit 105 is configured to synchronicitously energize the LEDs 240 with an audio file that is executed by the digital audio device 165. Controls 260 and controls 255 can be used to, for example, turn the acoustic string instrument on/off, control the volume, and/or control one or more functionalities of the acoustic string instrument 200.

Figure 3:
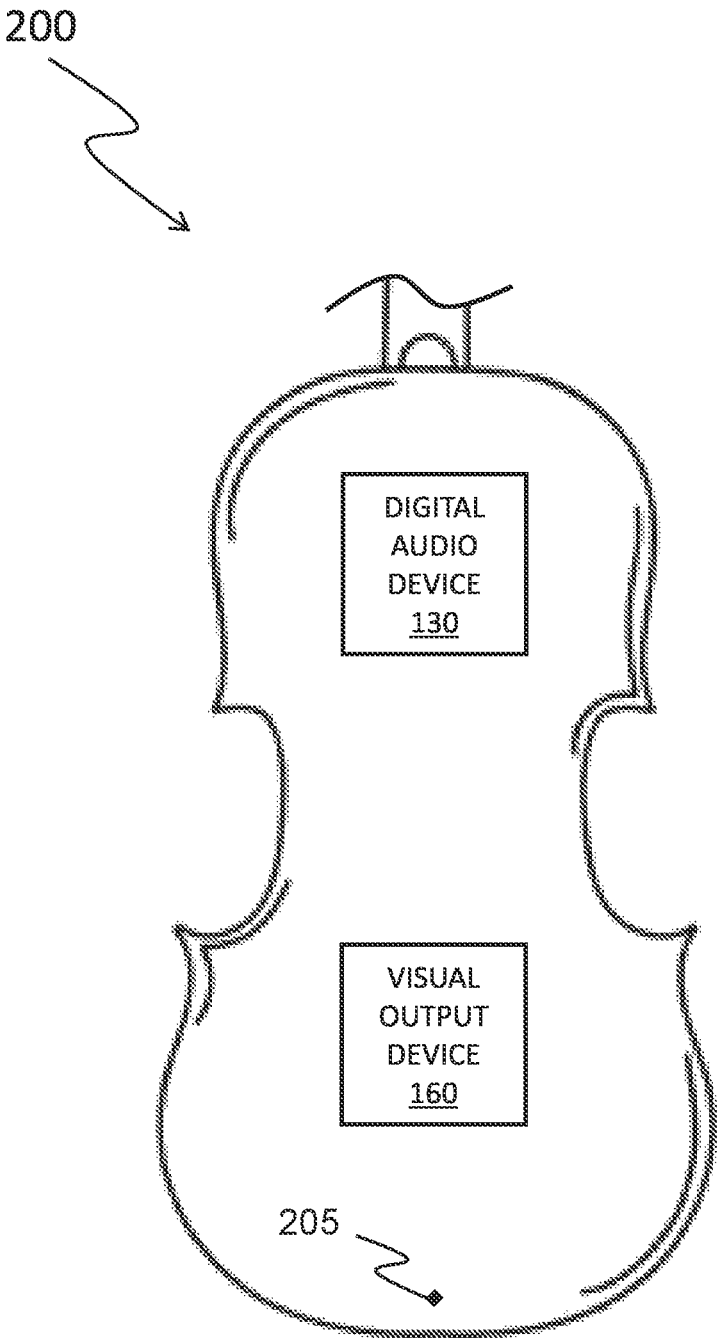
FIG. 3 illustrates a rear view of the acoustic string instrument of FIG. 2, according to certain embodiments.

FIG. 3 illustrates a rear view of the acoustic string instrument 200 of FIG. 2, according to other embodiments. Here, the digital audio device 130 is externally positioned on the rear of the acoustic string instrument 200. Similarly, the visual output device 160 is externally positioned on the rear of the acoustic string instrument 200. To be sure, the visual output device 160 can be positioned on any external surface of the acoustic string instrument 200.

Figure 4:
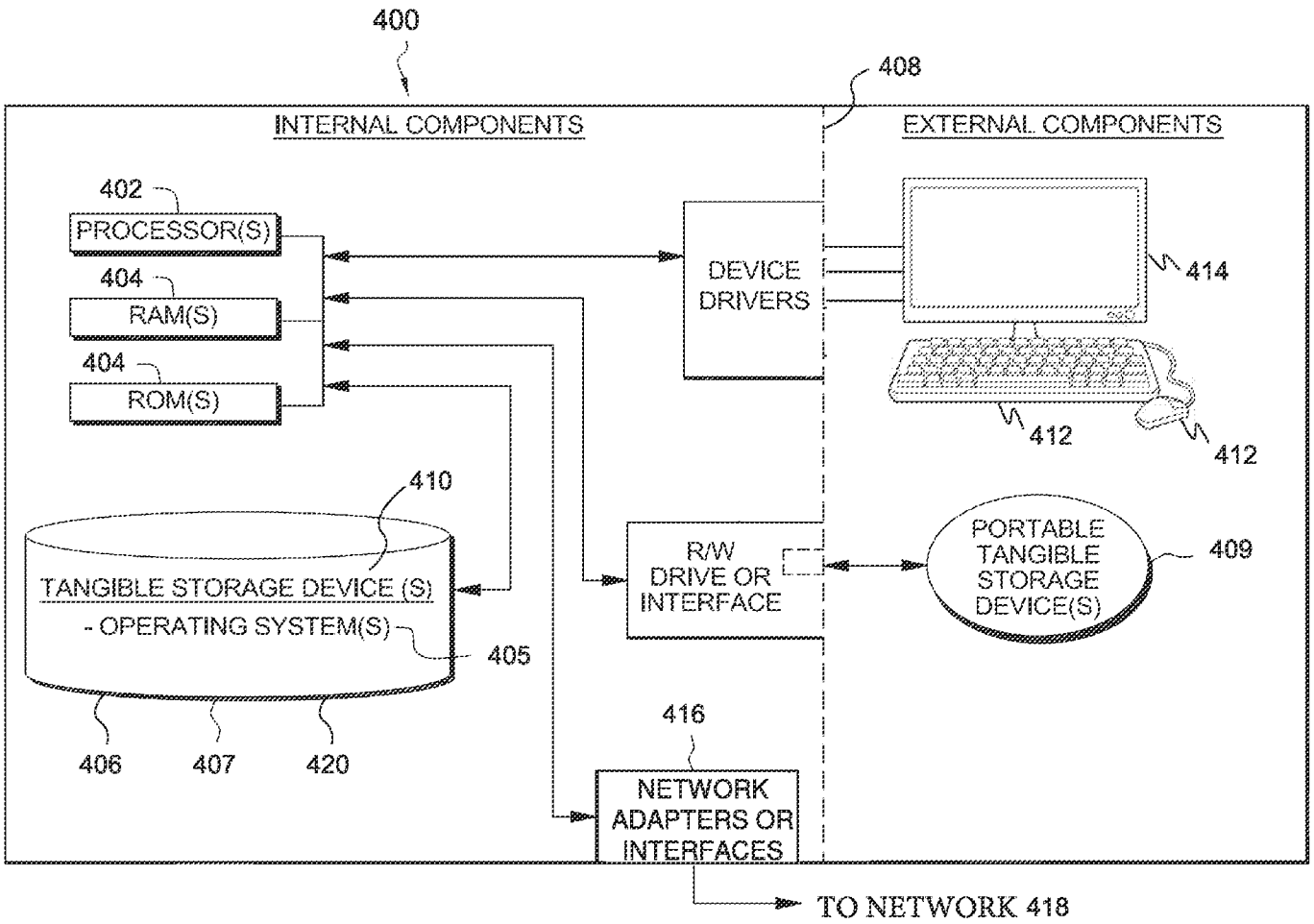
FIG. 4 depicts a block diagram of components of a data processing system, in accordance with some embodiment.

With reference to FIG. 4, a system consistent with an embodiment of the disclosure may include a computing device or cloud service, such as computing device 400. Computing device 400 can represent the acoustic string instrument 100 and the digital audio source 165. In a basic configuration, computing device 400 may include at least one processing unit 402 (e.g., control circuit 112) and a system memory 404. Depending on the configuration and type of computing device, system memory 404 may comprise, but is not limited to, volatile (e.g. random-access memory (RAM)), non-volatile (e.g. read-only memory (ROM)), flash memory, or any combination. System memory 404 may include operating system 405, one or more programming modules 406, and may include a program data 407. Operating system 405, for example, may be suitable for controlling computing device 400's operation. In one embodiment, programming modules 406 may include machine learning module. Furthermore, embodiments of the disclosure may be practiced in conjunction with a graphics library, other operating systems, or any other application program and is not limited to any particular application or system. This basic configuration is illustrated in FIG. 4 by those components within a dashed line 408.

Computing device 400 may have additional features or functionality. For example, computing device 400 may also include additional data storage devices (removable and/or non-removable) such as, for example, magnetic disks, optical disks, or tape. Such additional storage is illustrated in FIG. 4 by a removable storage 409 and a non-removable storage 410. Computer storage media may include volatile and nonvolatile, removable and non-removable media implemented in any method or technology for storage of information, such as computer-readable instructions, data structures, program modules, or other data. System memory 404, removable storage 409, and non-removable storage 410 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 400. Any such computer storage media may be part of device 400. Computing device 400 may also have input device(s) 412 such as a keyboard, a mouse, a pen, a sound input device, a touch input device, a location sensor, a camera, a biometric sensor, etc. Output device(s) 414 such as a display, speakers, a printer, etc. may also be included. The aforementioned devices are examples and others may be used.

Computing device 400 may also contain a communication connection 416 that may allow device 400 to communicate with other computing devices 418, such as over a network in a distributed computing environment, for example, an intranet or the Internet. Communication connection 416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 404, including operating system 405. While executing on processing unit 402 (e.g., control circuit 105), programming modules 406 (e.g., application 420 such as a media player) may perform processes including, for example, one or more stages of methods, algorithms, systems, applications, servers, databases as described above. The aforementioned process is an example, and processing unit 402 (e.g., control circuit 105) may perform other processes. Other programming modules that may be used in accordance with embodiments of the present disclosure may include machine learning application.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Although the disclosure has been explained in relation to its preferred embodiment, it is to be understood that many other possible modifications and variations can be made without departing from the spirit and scope of the disclosure.

What is claimed is:

1. An acoustic musical instrument, comprising:
a hollow body;
a neck that extends from the hollow body;
a speaker;
a digital audio device;
a control circuit communicatively coupled to the speaker and the digital audio device;
wherein
the speaker is externally positioned on the hollow body;
the digital audio device is externally positioned on the hollow body;
a power source;
the power source being one or more batteries;
a musical instrument digital interface ("MIDI") component;
an electronic tuner;
a plurality of light emitting diodes ("LEDs") positioned on the neck;
an amplifier board;
the control circuit is communicatively coupled to the power source, the MIDI component, the electronic tuner, the amplifier board, and the plurality of LEDs;
the control circuit is configured to synchronicitously energize the LEDs with an audio file that is executed by the digital audio device; and
the control circuit is configured to synchronicitously energize the LEDs according to instructions received external to the acoustic musical instrument.

2. The acoustic musical instrument of claim 1, wherein the speaker is communicatively coupled to the amplifier board.

3. The acoustic musical instrument of claim 2,
further comprising an effects board; and
wherein the control circuit is communicatively coupled to effects board.

4. The acoustic musical instrument of claim 3, wherein
the control circuit is configured to capture, via the digital audio device, sounds that are generated by the acoustic musical instrument as a primary digital audio file when the acoustic musical instrument is in use.

5. The acoustic musical instrument of claim 4,
further comprising a communications device;
wherein
the control circuit is communicatively coupled to the communications device;
the control circuit is configured to:
receive, via the communications device, a secondary digital audio file from a digital audio source for execution by the digital audio device; and
transmit, via the communications device, the primary digital audio file to the digital audio source, via a network.

6. The acoustic musical instrument of claim 5,
further comprising a sound capture device; and
wherein the control circuit is communicatively coupled to sound capture device.

7. An acoustic musical instrument, comprising:
a hollow body;
a neck that extends from the hollow body;
a speaker;
a digital audio device;
a musical instrument digital interface ("MIDI") component;
a control circuit communicatively coupled to the speaker, the digital audio device, and the MIDI component;
wherein
the speaker is externally positioned on the hollow body;
the digital audio device is externally positioned on the hollow body;
a power source;
the power source being one or more batteries;
an electronic tuner;
a plurality of light emitting diodes ("LEDs") positioned on the neck;
an amplifier board;

the control circuit is communicatively coupled to the power source, the electronic tuner, the amplifier board, and the plurality of LEDs;

the control circuit is configured to synchronicitously energize the LEDs with an audio file that is executed by the digital audio device;

the control circuit is configured to synchronicitously energize the LEDs according to instructions received external to the acoustic musical instrument; and the speaker is communicatively coupled to the amplifier board.

8. The acoustic musical instrument of claim 7, further comprising an effects board; and wherein the control circuit is communicatively coupled to effects board.

9. The acoustic musical instrument of claim 8, wherein the control circuit is configured to capture, via the digital audio device, sounds that are generated by the acoustic musical instrument as a primary digital audio file when the acoustic musical instrument is in use.

10. The acoustic musical instrument of claim 9, further comprising a communications device;

wherein the control circuit is communicatively coupled to the communications device;

the control circuit is configured to:

receive, via the communications device, a secondary digital audio file from a digital audio source for execution by the digital audio device; and transmit, via the communications device, the primary digital audio file to the digital audio source, via a network.

11. The acoustic musical instrument of claim 10, further comprising a sound capture device; and wherein the control circuit is communicatively coupled to sound capture device.

* * * * *